US006698226B1

(12) United States Patent
Mahloch

(10) Patent No.: US 6,698,226 B1
(45) Date of Patent: Mar. 2, 2004

(54) REFRIGERATOR INTERIOR CLEANING SYSTEM

(76) Inventor: Gregory Mahloch, 11813 Hickory Rd., Omaha, NE (US) 68144

( * ) Notice: Subject to any disclaimer, the term of this patent is extended or adjusted under 35 U.S.C. 154(b) by 0 days.

(21) Appl. No.: 10/407,368

(22) Filed: Apr. 4, 2003

(51) Int. Cl.[7] ..... F28G 5/00
(52) U.S. Cl. ..... 62/303; 62/272
(58) Field of Search ..... 62/303, 272, 440

(56) References Cited

U.S. PATENT DOCUMENTS 3,320,964 A * 5/1967 Tripp ..... 134/100.1
4,315,414 A * 2/1982 Ibrahim ..... 62/231
6,640,818 B1 * 11/2003 Talisman ..... 134/89

FOREIGN PATENT DOCUMENTS

JP 401222183 A * 9/1989 ..... 62/246

* cited by examiner

*Primary Examiner*—Melvin Jones
(74) *Attorney, Agent, or Firm*—Adam H. Jacobs

(57) ABSTRACT

A refrigerator interior cleaning system includes an upright refrigerator having an interior compartment and at least one door hingedly mounted thereon for closing the interior compartment. A plurality of spray nozzles are mounted within the interior compartment of the upright refrigerator, and a pumping device is connected to the plurality of spray nozzles in fluid transmission connection therewith. A drain is mounted within the interior compartment and extends outwards therefrom for draining fluid from within the interior compartment, and a door locking device is mounted on the upright refrigerator adjacent the door, the door locking device operative to lock the door in a closed position such that the door and the interior compartment cooperate to form a generally fluid-tight seal. Finally, the plurality of spray nozzles are operative to spray fluid therefrom into the interior compartment for cleaning the interior compartment of the upright refrigerator.

13 Claims, 4 Drawing Sheets

REFRIGERATOR INTERIOR CLEANING SYSTEM

BACKGROUND OF THE INVENTION

1. Technical Field

The present invention relates to cleaning systems for household appliances and, more particularly, to an upright refrigerator having at least one door mounted thereon and a refrigerator interior cleaning system which includes a pumping device and fluid transfer connection to a plurality of spray nozzles mounted within the refrigerator interior, a drain for removing the liquid from the interior of the refrigerator and a locking mechanism mounted on or adjacent the door for securely closing and making a fluid-tight seal between the door and the body of the refrigerator.

2. Description of the Prior Art

Modern kitchen appliances are wonders of performance and efficiency compared to those appliances which were used previously. For example, today's refrigerators can make ice, dispense water, and include a variety of other novel features which permit the storage of all kinds of foodstuffs. Today's refrigerators include plexiglass shelves, spill-catching lips, and many other features of convenience which older refrigerators simply did not have. One thing that has not been addressed and corrected, however, is the fact that even the best spill-catching lip cannot catch every spill and, over the course of use of the refrigerator, the interior of the refrigerator will become stained, soiled, or otherwise dirtied from foodstuffs stored within the refrigerator. Currently, to effectively clean the interior of the refrigerator, one must remove all of the material from the inside of the refrigerator and hand wash each and every one of the shelves, drawers, and other elements of the interior of the refrigerator, a time-consuming chore to say the least. There is therefore a need for an improved system for cleaning the interior of a refrigerator.

Other types of household appliances, such as dishwashers and ovens, include self-cleaning mechanisms. Clearly, however, the self-cleaning mechanism used in an oven is not usable in a refrigerator situation, due to the intense heat levels required for proper cleaning of the oven. Perhaps, however, it would be possible to modify the cleaning mechanism found in a dishwasher for use in a refrigerator. Several examples in the prior art have attempted to utilize the spraying of water to clean the interior of a refrigerator, including Ibrahim, U.S. Pat. No. 4,315,414 and Yono et al., U.S. Pat. No. 4,416,120, each of which disclose spray assemblies for refrigerated display cases of the kind commonly found in commercial situations. It is clear, however, that neither of these two devices provide a thorough cleaning of interior of the refrigerated space, much less cleaning each and every part of the interior refrigerated space, and thus do not completely solve the cleaning problem. Furthermore, use of the systems shown in Ibrahim and Yono et al. in a standard upright refrigerator would destroy the functionality of both of the devices as described besides not properly cleaning the interior of the refrigerator. There is therefore a need for a liquid spray cleaning mechanism for refrigerator interiors which is usable with upright refrigerators, completely and swiftly cleans the interior of the refrigerator and is relatively easy to use.

Therefore, an object of the present invention is to provide an improved refrigerator interior cleaning system.

Another object of the present invention is to provide an improved refrigerator interior cleaning system which includes a plurality of spray nozzles mounted within the refrigerator, the spray nozzles connected to a pumping device in fluid transmission connection therewith such that activation of the pumping device causes fluid to shoot from the spray nozzles thus cleaning the interior of the refrigerator.

Another object of the present invention is to provide a locking mechanism for the door of the refrigerator which provides a fluid-tight seal for the door to keep all cleaning fluids within the interior of the refrigerator during the cleaning process.

Another object of the present invention is to provide an improved refrigerator interior cleaning system which includes a plurality of rotating or oscillating spray arms on the ends of which are a plurality of nozzles to provide enhanced cleaning for the interior of the refrigerator.

Finally, an object of the present invention is to provide an improved refrigerator interior cleaning system which is relatively simple and durable in construction and is safe and efficient in use.

SUMMARY OF THE INVENTION

The present invention provides a refrigerator interior cleaning system including an upright refrigerator having an interior compartment and at least one door hingedly mounted thereon for closing the interior compartment. A plurality of spray nozzles are mounted within the interior compartment of the upright refrigerator, and a pumping device is connected to the plurality of spray nozzles in fluid transmission connection therewith. A drain is mounted within the interior compartment and extends outwards therefrom for draining fluid from within the interior compartment, and a door locking device is mounted on the upright refrigerator adjacent the door, the door locking device operative to lock the door in a closed position such that the door and the interior compartment cooperate to form a generally fluid-tight seal. Finally, the plurality of spray nozzles are operative to spray fluid therefrom into the interior compartment for cleaning the interior compartment of the upright refrigerator.

The refrigerator interior cleaning system of the present invention thus provides a substantial improvement over those systems found in the prior art. For example, in an upright refrigerator, the door must be sealed during cleaning to prevent the cleaning water from accidentally being discharged, a feature not found in the prior art. Furthermore, the use of high-pressure heated water will provide a far superior cleaning than other cleaning devices and systems found in the prior art. Also, the use of rotating cleaning arms such as those used in a dishwasher will increase the cleaning capabilities of the present invention, and the positioning of the arms immediately beneath each of the shelves will not interfere with the placing and storing of foodstuffs within the refrigerator. Finally, the positioning of the spray nozzles in various locations within the refrigerator will permit cleaning of the entire interior of the refrigerator, a result not accomplished by the prior art. It is thus seen that the refrigerator interior cleaning system of the present invention is superior and in fact unique when compared to those systems found in the prior art.

DESCRIPTION OF THE PREFERRED EMBODIMENT

Figure 2:
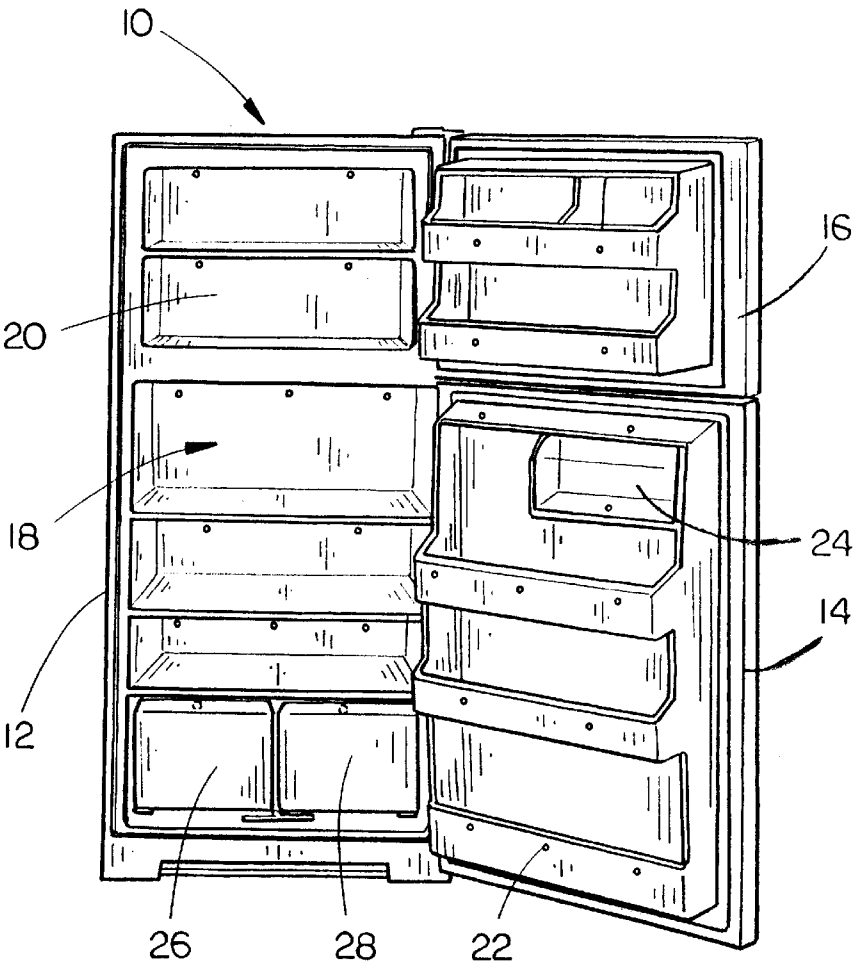
FIG. 2 is a perspective view of a first embodiment of the present invention with the spray nozzles in the interior of the refrigerator being shown.

The refrigerator interior cleaning system 10 of the present invention is shown best in FIGS. 1–4 including an upright refrigerator 12 having a refrigerator door 14 and freezer door 16 for closing, respectively, the refrigerator interior 18 and freezer interior 20. Of course, it should be noted that numerous different types of door arrangements may be used with the present invention such as those commonly referred to as side-by-side refrigerators and even the recently developed three-door refrigerator units, in addition to any other variations used previously or which are being developed.

Figure 3:
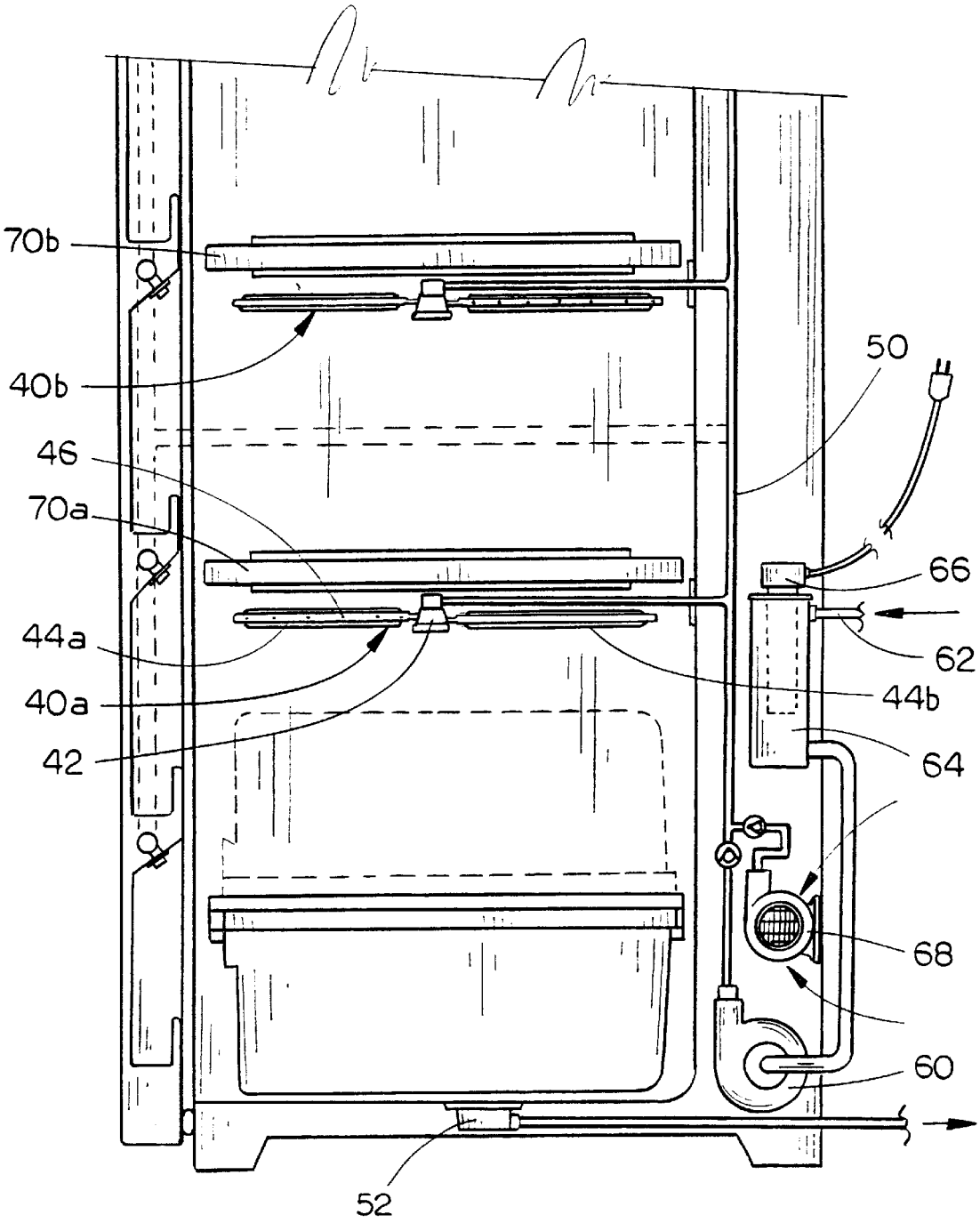
FIG. 3 is a detail side elevational view of the second embodiment of the present invention showing the fluid transfer connections from the pump to the spray nozzles.
Figure 4:
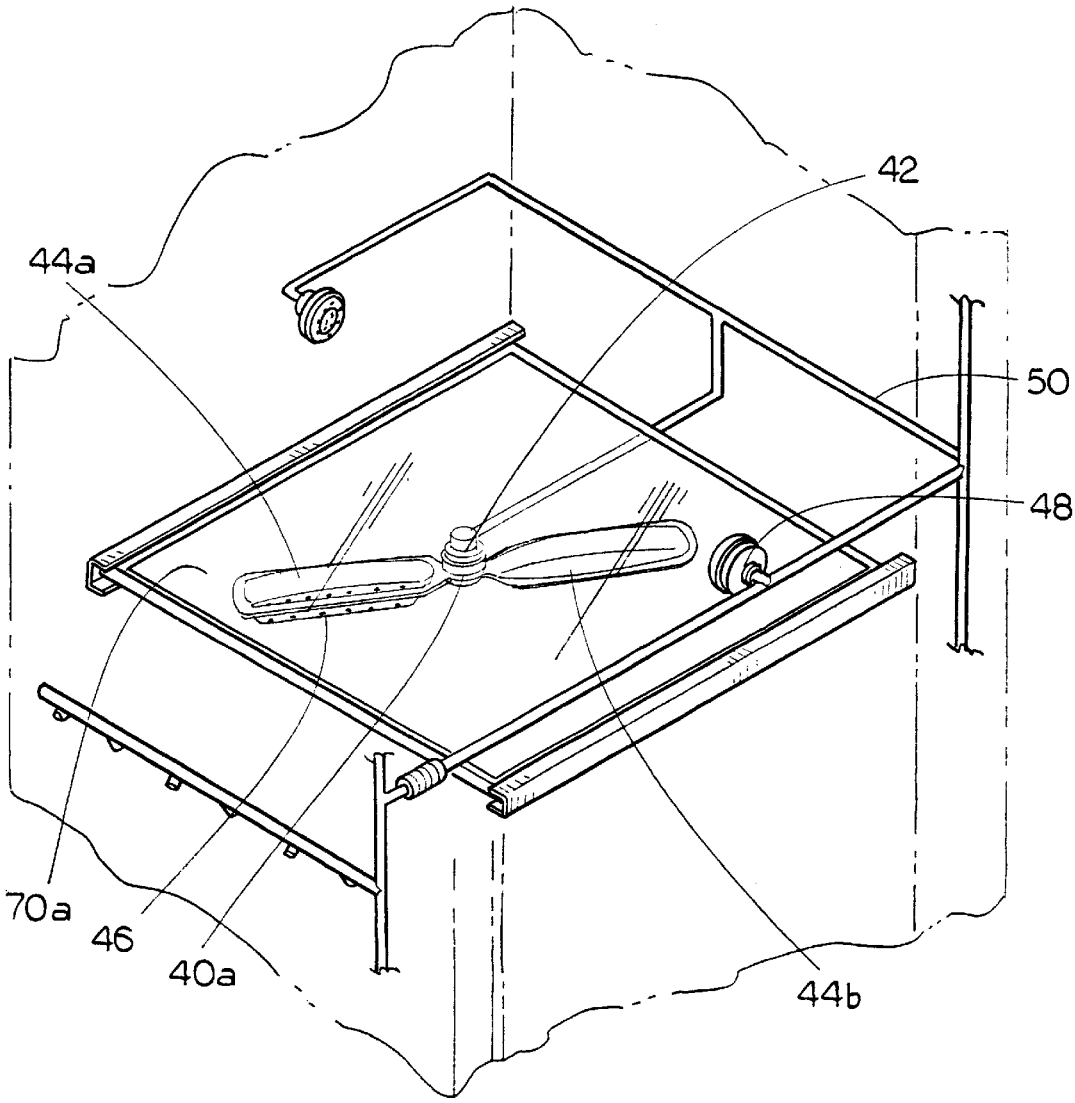
FIG. 4 is a detail perspective view of the present invention showing various nozzles and the piping therefor.

The cleaning system 10 of the present invention is shown in its two preferred embodiments in FIGS. 2, 3, and 4, with the first embodiment being shown in FIG. 2. The first embodiment of the cleaning system 10 of the present invention would include a plurality of spray nozzles 22 mounted within the refrigerator interior 18 and freezer interior 20 and positioned such that water and/or cleaning fluid ejected from the spray nozzles 22 contacts and cleans virtually every part of the refrigerator interior 18 and freezer interior 20. The precise number, size, and shape of the spray nozzles 22 is not critical to the present invention so long as the intended purpose of cleaning the entire interior of the refrigerator interior 18 and freezer interior 20 is accomplished. In the preferred embodiment, the spray nozzles 22 would be fan-type nozzles which spray a fan-shaped stream of liquid outwards therefrom to fully clean the refrigerator and/or freezer interior 18 and 20 across from the spray nozzle 22. Furthermore, spray nozzles may be mounted within the various food storage bins 24, 26, and 28 of the refrigerator, enabling the cleaning of the bins 24, 26, and 28 without requiring removal and cleaning of the bin, the procedure ordinarily mandated for a thorough cleaning of the bin. Of course, it should be noted that the spray nozzles 22 may be of many different types, including oscillating nozzles, stream nozzles or any other type of nozzle so long as the nozzles 22 function to clean the interior of the refrigerator 12.

Figure 1:
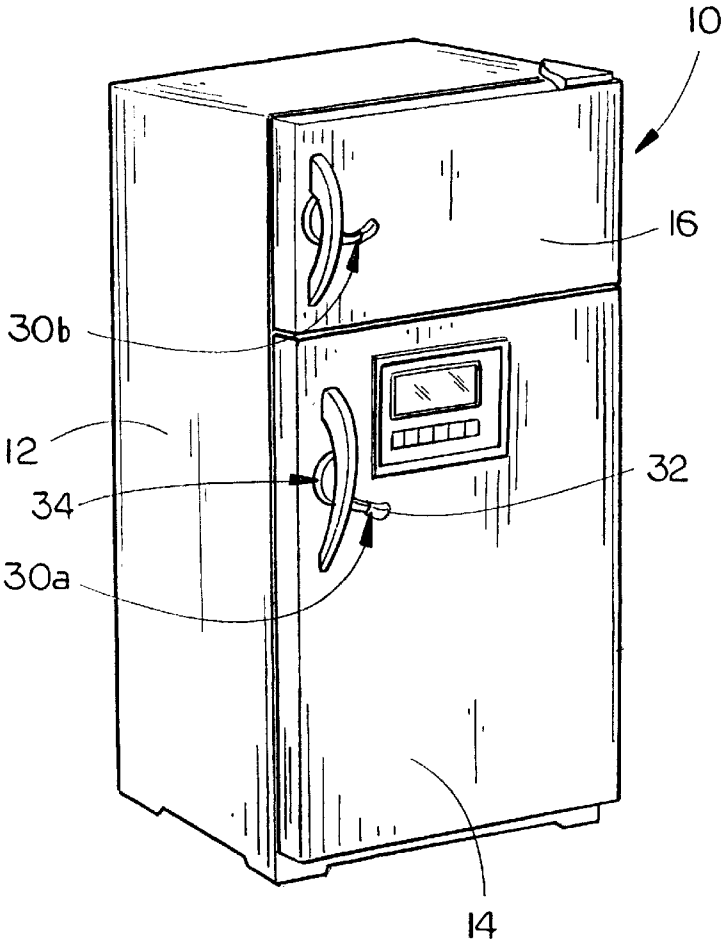
FIG. 1 is a perspective view of a refrigerator with the refrigerator interior cleaning system of the present invention installed therein.

As shown best in FIG. 1, the first embodiment further includes a pair of locking devices 30*a* and 30*b* mounted on the front faces of the refrigerator door 14 and freezer door 16 respectively. In the preferred embodiment, each of the locking devices 30*a* and 30*b* would operate in a similar manner, and therefore the description of locking device 30*a* should be understood to apply equally to locking device 30*b*. Locking device 30*a* includes a handle 32 which is rotatable through a range of motion between an unlocked position and a locked position. The locking mechanism 34 of locking device 30*a* would preferably include a latch which is rotatable into engagement with a latch plate mounted in the refrigerator 12 adjacent or inside of the refrigerator interior 18. by rotation of the handle 32. As the latch engages the latch plate, further rotation of the handle 32 is translated by the locking mechanism thus causing the locking mechanism 34 to pull the latch towards the locking mechanism 34 supported within the refrigerator door 14. Because the latch is engaging the latch plate, however, the upwards force exerted by the locking mechanism 34 pulls the refrigerator door 14 towards the body of the refrigerator 12. A rubberized sealing material is fitted around the perimeter of the refrigerator door 14 between the refrigerator door 14 and the refrigerator 12. The rubberized sealing material operates such that as the locking mechanism 34 draws the refrigerator door 14 towards the refrigerator 12, the rubberized sealing material seals the gap between the refrigerator door 14 and the refrigerator 12 thus creating a fluid-tight seal to prevent fluids from escaping from the refrigerator interior 18. Once the cleaning cycle has been started, the locking device 30*a* cannot be released, much the same as is done with self-cleaning ovens, until the cleaning cycle has been completed or interrupted by the operator.

Of course, the locking device 30*a* may be of any appropriate functional design so long as the intended functional characteristics are maintained. Specifically, the doors 14 and 16 must be sealed to the body of the refrigerator to prevent accidental or unintended release of fluids from the interior of the refrigerator 12. There are several different mechanisms known in door related prior art which would accomplish the intended objectives, but it is the use of the locking device 30*a* in connection with the refrigerator interior cleaning system 10 of the present invention which is novel and unique in the art.

The second preferred embodiment is shown best in FIGS. 3 and 4 as including a plurality of rotating spray bars 40*a* and 40*b* mounted within the refrigerator 12 beneath each of the shelves 70*a* and 70*b*. In the preferred embodiment, each of the rotating spray bars 40*a* and 40*b* would operate in a similar manner, and therefore the description of rotating spray bar 40*a* should be understood to apply equally to rotating spray bar 40*b*. Rotating spray bar 40*a* is preferably constructed of plastic or metal and would include a central pivot 42 and two outwardly extending arms 44*a* and 44*b* in fluid transmission connection with the central pivot 42, on each of which are a plurality of spray nozzles 46. A fluid transfer tube 50 is connected to the central pivot 42 such that fluid such as water or another type of cleaning fluid enters. the central pivot 42 through the fluid transfer tube 50 and is distributed through the central pivot 42 to the two outwardly extending arms 44*a* and 44*b*. The fluid is then ejected through the bar spray nozzles 46, which are oriented such that as fluid is ejected through the bar spray nozzles 46, the force causes the arms 44*a* and 44*b* to rotate about central pivot 42, thus causing fluid to be deposited on the interior surfaces of the refrigerator interior 18.

Other types of rotating and extending arms may be used with the present invention, including "pop-up" types of arms which extend upwards to clean areas of the refrigerator 12 which are difficult to reach, and spinning arms which create different forms of fluid spray for enhancing the cleaning capabilities of the present invention. Each of these types of arms are usable with the present invention, depending on the desired cleaning characteristics.

The speed and force of the ejected fluid through the arms 44*a* and 44*b* is controlled by the pump device 60, shown best in FIG. 3, which is connected in fluid transmission connection with the spray bars 40*a* and 40*b* through a series of fluid transfer tubes 50. It is expected that a pump 60 similar to that used in home dishwashers will be used with the present invention, as such a pump 60 will provide sufficient force to the fluid for ejection from the bar spray nozzles 46 while being efficient and quiet in operation. Of course, many different arrangements of fluid transfer tubes 50 and pumps 60 may be used so long as the functionality of the invention is neither degraded nor destroyed. It may even be preferable to include several additional spray nozzles 48, such as those shown in FIG. 4, to provide additional cleaning capability for the present invention. Finally, it should be noted that although the embodiment of FIG. 2 does not show a pump device, the system would be similar to that described in connection with FIG. 3, and thus should be read as including a pump device.

Fluid for the pump device 60 would likely be obtained via a standard water feed line 62 for a refrigerator 12, as shown in FIG. 3, and a soap or detergent reservoir 64 may also be included for adding cleaning solution to the water presently used for cleaning the refrigerator interior 18. Also, a heater unit 66 may be included for heating the water and/or air prior to use of it for cleaning or drying purposes. Finally, the present invention contemplates the use of an air blower 68 connected to the fluid transfer tubes 50 such that the fluid transfer tubes 50 and hence the spray nozzles 22 and 46 will send air into the refrigerator and freezer interiors 18 and 20 for drying of the interiors, thus decreasing the amount of time needed to run the cleaning cycle.

Figure 5:
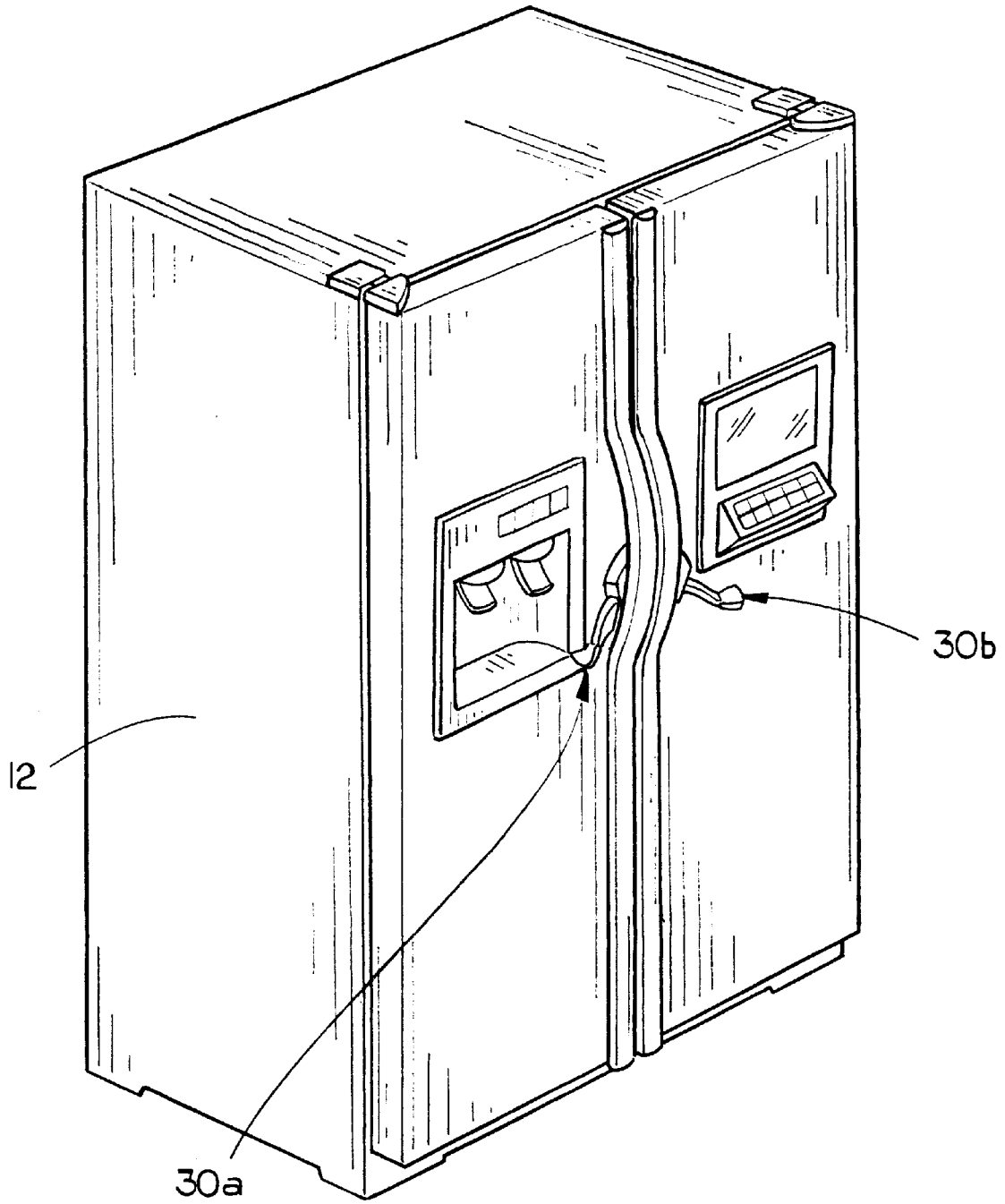
FIG. 5 is a perspective view of a side-by-side refrigerator outfitted with the refrigerator interior cleaning system of the present invention.

FIG. 5 shows the use of the present invention on a side-by-side refrigerator, with the locking devices 30*a* and 30*b* mounted adjacent each upright door. FIG. 5 is illustrative of the point that the present invention can be used with many types of refrigerators and freezers, and the size, shape and number of doors does not matter for use of the present invention.

The cleaning cycle of the present invention is described herein in connection with the first and second embodiments combined in order to show the functional characteristics of the invention, but of course any person skilled in the art will recognize and identify which elements of the invention belong to which embodiment. The user of the present invention would first remove all foodstuffs from the interior of the refrigerator 12, cover any sensitive electronics within the refrigerator 12 via a cover or the like (not shown) and invert any lower food storage bins for cleaning, if necessary. The locking mechanisms 30*a* and 30*b* are then engaged to secure the refrigerator and freezer doors 14 and 16 in fluid-tight locked position against the refrigerator 12. The refrigerator interior cleaning system 10 would then be activated and pump device 60 would begin to force water and/or cleaning fluid through fluid transfer tubes 50. The water and/or cleaning fluid would enter the rotating spray bars 40*a* and 40*b* and the spray nozzles 22 and be ejected therefrom at a relatively high rate of speed to impact the interior walls and surfaces of the refrigerator interior 18 and the freezer interior 20 to loosen and remove foodstuffs, stains, spills and all other foreign objects and materials from the refrigerator 12. All of the waste cleaning fluid and removed matter is then directed into the drain 52 positioned at the bottom of the refrigerator 12 as shown in FIG. 3, and the drain 52 conveys the waste cleaning fluid and removed matter to the sewer system to which the residence is connected. The spray portion of the cycle then ends and the air blower 68 is engaged to dry the refrigerator and freezer interiors 18 and 20. Upon completion of the drying portion of the cycle, the locking mechanisms 30*a* and 30*b* are released and the foodstuffs may be reinserted into the refrigerator 12. The refrigerator 12 is thus cleaned in a simple and efficient manner and the user of the refrigerator 12 thus need not occupy his or her time with the cleaning of the interior of the refrigerator 12.

It is to be noted that numerous additions, modifications, and substitutions may be made to the refrigerator interior cleaning system of the present invention which fall within the intended broad scope of the appended claims. For example, the specific location, size, shape and pressure of the spray nozzles 22 may be modified or changed to work in various refrigerator configurations, so long as the desired result of cleaning of the interior of the refrigerator is achieved. Furthermore, the orientation, size and attitude of the spray arms and other cleaning elements may be modified or changed. Also, the specific pump type and capacity, blower capacity, door locking mechanism and details of the remaining elements of the present invention may be modified and changed so long as the functionality of the present invention is neither degraded nor destroyed. Finally, it is important to note that, although there are several cleaning devices for commercial-type refrigerator units currently available, none of the prior art devices is usable with an upright refrigerator without requiring major modifications which would destroy the functionality of those inventions for their intended purpose.

There has therefore been shown and described a refrigerator interior cleaning system which accomplishes at least all of its intended objectives.

I claim:

1. A refrigerator interior cleaning system comprises:

an upright refrigerator having an interior compartment and at least one door hingedly mounted thereon for closing said interior compartment;

a plurality of spray nozzles mounted within said interior compartment of said upright refrigerator;

at least one rotating spray bar rotatably mounted within said interior compartment on which at least one of said plurality of spray nozzles is mounted, said rotating spray bar operative to rotate to enhance fluid distribution from said at least one of said plurality of spray nozzles for increased cleaning of said interior compartment;

pump means in fluid transmission connection with said plurality of spray nozzles;

drain means mounted within said interior compartment and extending outwards therefrom for draining fluid from within said interior compartment;

door locking means mounted on said upright refrigerator adjacent said at least one door, said door locking means operative to lock said at least one door in a closed position such that said at least one door and said interior compartment cooperate to form a generally fluid-tight seal; and said plurality of spray nozzles operative to spray fluid therefrom into said interior compartment for cleaning said interior compartment of said upright refrigerator.

2. The refrigerator interior cleaning system of claim 1 wherein said refrigerator is a side-by-side type of refrigerator having two doors.

3. The refrigerator interior cleaning system of claim 1 wherein said refrigerator further includes at least one shelf mounted therein and said at least one rotating spray bar is mounted on said at least one shelf.

4. The refrigerator interior cleaning system of claim 1 further comprising an air blower device connected in fluid transmission connection with said plurality of spray nozzles for injecting air into said interior compartment for drying thereof.

5. The refrigerator interior cleaning system of claim 1 further comprising a heater operative to heat fluid prior to the fluid being ejected from said plurality of spray nozzles whereby the cleaning ability of the cleaning system is enhanced.

6. The refrigerator interior cleaning system of claim 1 wherein said at least one rotating spray bar comprises a central pivot and at least one outwardly extending arm in fluid transmission connection with said central pivot on which is mounted at least one spray nozzle operative to eject fluid therethrough, said at least one spray nozzle oriented such that as fluid is ejected through said at least one spray nozzle, reactive force causes rotation of said at least one outwardly extending arm about said central pivot, thus causing fluid to be deposited on interior surfaces of said interior compartment.

7. A refrigerator interior cleaning system comprises:

an upright refrigerator having an interior compartment and at least one door hingedly mounted thereon for closing said interior compartment;

a plurality of spray nozzles mounted within said interior compartment of said upright refrigerator;

pump means in fluid transmission connection with said plurality of spray nozzles;

drain means mounted within said interior compartment and extending outwards therefrom for draining fluid from within said interior compartment;

door locking means mounted on said upright refrigerator adjacent said at least one door, said door locking means operative to lock said at least one door in a closed position such that said at least one door and said interior compartment cooperate to form a generally fluid-tight seal; and said plurality of spray nozzles operative to spray fluid therefrom into said interior compartment for cleaning said interior compartment of said upright refrigerator.

8. The refrigerator interior cleaning system of claim 7 wherein said refrigerator is a side-by-side type of refrigerator having two doors.

9. The refrigerator interior cleaning system of claim 7 further comprising at least one rotating spray bar rotatably mounted within said interior compartment on which at least one of said spray nozzles is mounted, said rotating spray bar operative to rotate to enhance fluid distribution from said at least one of said spray nozzles for increased cleaning of said interior compartment.

10. The refrigerator interior cleaning system of claim 9 wherein said refrigerator further includes at least one shelf mounted therein and said at least one rotating spray bar is mounted on said at least one shelf.

11. The refrigerator interior cleaning system of claim 7 further comprising an air blower device connected in fluid transmission connection with said plurality of spray nozzles for injecting air into said interior compartment for drying thereof.

12. The refrigerator interior cleaning system of claim 7 further comprising a heater operative to heat fluid prior to the fluid being ejected from said plurality of spray nozzles whereby the cleaning ability of the cleaning system is enhanced.

13. The refrigerator interior cleaning system of claim 9 wherein said at least one rotating spray bar comprises a central pivot and at least one outwardly extending arm in fluid transmission connection with said central pivot on which is mounted at least one spray nozzle operative to eject fluid therethrough, said at least one spray nozzle oriented such that as fluid is ejected through said at least one spray nozzle, reactive force causes rotation of said at least one outwardly extending arm about said central pivot, thus causing fluid to be deposited on interior surfaces of said interior compartment.

* * * * *